United States Patent [19]

Ostrelich

[11] Patent Number: 4,688,340

[45] Date of Patent: Aug. 25, 1987

[54] TRAVEL STEAM AND DRY IRON

[75] Inventor: Michael J. Ostrelich, Fairfield, Conn.

[73] Assignee: Black & Decker Inc., Newark, Del.

[21] Appl. No.: 691,879

[22] Filed: Jan. 16, 1985

[51] Int. Cl.[4] ..... D06F 75/14; D06F 75/34

[52] U.S. Cl. ..... 38/90; D32/72; 219/252; 16/126; 38/77.8; 38/85; 38/89; 38/77.81; 74/553

[58] Field of Search ..... 190/115, 117; 294/137, 294/167, 169; D32/68, 69, 70, 71, 72; 219/488, 249, 250, 255, 252; 220/94 R; 16/378, 112, 126; 38/92, 77.5, 77.4, 90, 77.8, 89, 85, 77.81, 77.7; 74/553, 548; 116/329

[56] References Cited

U.S. PATENT DOCUMENTS

| | | | |
|---|---|---|---|
| 2,750,695 | 6/1956 | Swenson | 38/77.4 X |
| 2,763,075 | 9/1956 | Vance | 38/77.4 |
| 2,873,329 | 2/1959 | Swenson | 219/252 X |
| 3,229,392 | 1/1966 | Camilleri | 38/90 |
| 3,503,586 | 3/1970 | Bordes | 74/553 |
| 3,665,152 | 5/1972 | Foster et al. . | |
| 3,665,374 | 5/1972 | Denton . | |
| 3,672,080 | 6/1972 | Murphy et al. | 38/90 |
| 3,675,351 | 7/1972 | Downing . | |
| 3,725,848 | 4/1973 | Davidson . | |
| 3,858,160 | 12/1974 | Denton . | |
| 4,031,638 | 6/1977 | Ryckman, Jr. et al. . | |
| 4,045,894 | 9/1977 | Toft et al. . | |
| 4,091,551 | 5/1978 | Schaeffer . | |
| 4,107,860 | 8/1978 | Coggiola . | |
| 4,131,033 | 12/1978 | Wright et al. | 74/553 |
| 4,366,367 | 12/1982 | Mazzucco | 38/77.4 X |
| 4,484,399 | 11/1984 | Biancalani | 38/77.8 X |
| 4,565,019 | 1/1986 | Cavalli | 38/77.6 |
| 4,594,801 | 1/1986 | Gronwick et al. | 38/90 |

FOREIGN PATENT DOCUMENTS

| | | | |
|---|---|---|---|
| 691576 | 7/1964 | Canada | 16/126 |
| 716805 | 1/1942 | Fed. Rep. of Germany | 38/77.81 |
| 2532526 | 2/1977 | Fed. Rep. of Germany | 38/85 |
| 2538243 | 3/1977 | Fed. Rep. of Germany | 38/77.8 |
| 2615565 | 10/1977 | Fed. Rep. of Germany | 38/77.8 |
| 476287 | 12/1937 | United Kingdom | 38/77.81 |

*Primary Examiner*—Werner H. Schroeder
*Assistant Examiner*—Andrew M. Falik
*Attorney, Agent, or Firm*—Finnegan, Henderson, Farabow, Garrett & Dunner

[57] ABSTRACT

A travel iron has a hollow handle defining a liquid reservoir which is pivotally mounted for movement between operative and stored positions. The handle is releasably secured in the operative position by a sliding latch. A conduit supplies liquid from the reservoir to the soleplate. A manually operated valve and a gravity operated valve control fluid flow through the conduit.

56 Claims, 9 Drawing Figures

TRAVEL STEAM AND DRY IRON

BACKGROUND OF THE INVENTION

1. Field of the Invention

The present invention relates to a portable apparatus for ironing clothes and other textiles.

2. Description of the Prior Art

Travel irons have been in use for a considerable period of time and are characterized by their portability. Such irons are designed to be light in weight and compact in size. However, known travel irons have had to compromise versatility and performance to obtain their necessary light weight and compact size.

The compact design of known travel irons has presented problems in maintaining uniform heating of the soleplate of the iron while limiting the amount of heat transmitted to the handle and housing. Known travel irons have required a complex arrangement of parts to be lightweight and small in size, resulting in a costly and unattractive product.

Another problem with known travel irons is incorporation of a steam generating mechanism in a compact design. Known travel irons which are both lightweight and compact in size have had shortcomings in attempting to provide a liquid reservoir that is accessible, well balanced, isolated from the heating element, leak proof, and in communication with the steam generating surface in a controlled fashion.

SUMMARY OF THE INVENTION

Accordingly, it is an object of the present invention to provide a travel iron which allows for uniform heating of the soleplate of the iron while limiting the amount of heat transmitted to the handle and housing.

It is another object of the present invention to provide a travel iron having a simple arrangement of parts which form a lightweight and portable apparatus that is low in cost and attractive in appearance.

It is a further object of the present invention to provide a travel iron having the capability of generating steam in which the liquid reservoir is placed and arranged in such a manner that it is accessible, well balanced, isolated from the heating element, leak proof, and in communication with the steam generating surface in a controlled fashion.

Additional objects and advantages of the invention will be set forth in the description which follows, and in part will be obvious from the description, or may be learned from practice of the invention. The objects and advantages of the invention may be realized and obtained by means of the instrumentalities and combinations particularly pointed out in the appended claims.

To achieve the foregoing objects, and in accordance with the purposes of the invention, as embodied and broadly described herein, a travel iron is provided comprising a soleplate having inner and outer surfaces and an array of steam ports communicating between the inner and outer surfaces, means for electrically heating the soleplate, means for controlling the temperature of the soleplate, housing means fixed to the soleplate, a substantial portion of the housing means being spaced from the soleplate for limiting heat transfer from the soleplate to the housing means, a hollow handle defining a liquid reservoir and pivotally mounted to the housing for movement between operative and stored positions, means for releasably securing the handle in the operative position, means for filling the handle with liquid, and conduit means for conducting liquid from the reservoir to the soleplate.

A travel iron of the subject invention preferably includes vent valve means in communication with the reservoir for allowing air to enter the reservoir and preventing liquid from leaving the reservoir. The handle of the travel iron preferably includes first and second pivot parts that are aligned and spaced for pivotal mounting to the housing, wherein the means for releasably securing the handle includes a keyway in the first pivot part and a sliding latch mounted on the housing proximate to the first pivot part and having a first sliding part for selective engagement with the keyway whereby the handle is releasably securable in the operative position when the handle is in the operative position and the latch is engaged with the keyway. Preferably the latch includes a second sliding part for selective engagement with a handle, the second sliding part spaced from th first sliding part, and wherein the second sliding part wedges the handle against the housing when in selective engagement with the handle. The iron is preferably positionable in an ironing position in which the soleplate is disposed in a horizontal plane and in a rest position in which the soleplate is disposed in a substantially vertical plane wherein the vent valve means is open when the iron is in an ironing position and closed when the iron is in a rest position.

The travel iron of the present invention also preferably includes conduit valve means for controlling fluid flow through the conduit means. The iron is preferably positionable in an ironing position in which the soleplate is disposed in a horizontal plane and in a rest position in which the soleplate is disposed in a substantially vertical plane, the conduit valve means having gravity operated valve means for permitting flow through the conduit means when the iron is disposed in the ironing position and for prohibiting flow through the conduit means when the iron is disposed in the rest position. The gravity operated valve means preferably includes a chamber and a slug slideable along a slide surface within the chamber between flow permitting and flow prohibiting positions. The slug preferably has a liquid receiving surface means oriented at an acute angle relative to the soleplate for allowing water droplets to slide off the liquid receiving surface means when the iron is in the ironing position.

The conduit valve means preferably includes a manually operated valve means for selectively controlling fluid flow through the conduit means. The outlet of the manually operated valve means preferably diverges to form a orifice means to deliver drops of liquid to the gravity operated valve means. The inner surface of the soleplate preferably includes a slanted steam boiler surface which communicates with the steam ports.

It is still further preferable that the travel iron include intermediate plate means between the housing means and the soleplate and that both the housing means and the intermediate plate means extend along at least a substantial portion of the area of the soleplate. The housing means and the intermediate plate means each preferably include a depending peripheral edge extending toward but spaced from the soleplate. Preferably, at least a substantial portion of the conduit valve means is located between the intermediate plate means and the housing means. The means for controlling the temperature of the soleplate preferably includes a temperature sensing means located near the central region of the soleplate and near the steam boiler surface.

BRIEF DESCRIPTION OF THE DRAWINGS

The accompanying drawings, which are incorporated in and constitute part of the specification, illustrate the preferred embodiment of the invention and, together with the general description of the invention given above and the detailed description of present invention given below, serve to explain the principles of the invention.

DESCRIPTION OF THE PREFERRED EMBODIMENT

Reference will now be made in detail to the present preferred embodiment of the invention as illustrated in the accompanying drawings.

Figure 1:
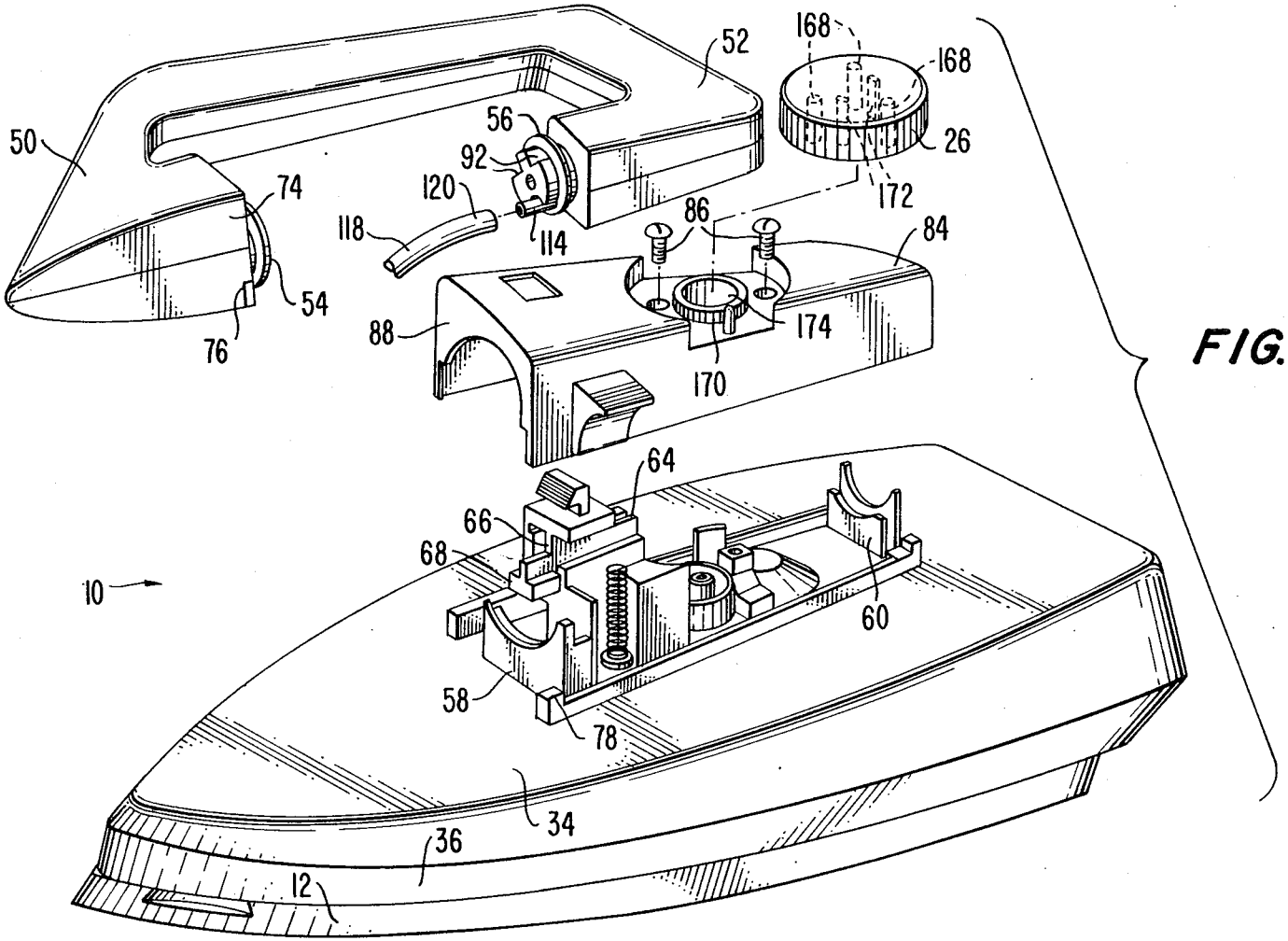
FIG. 1 is an exploded view of a travel iron incorporating the features of the present invention.
Figure 3:
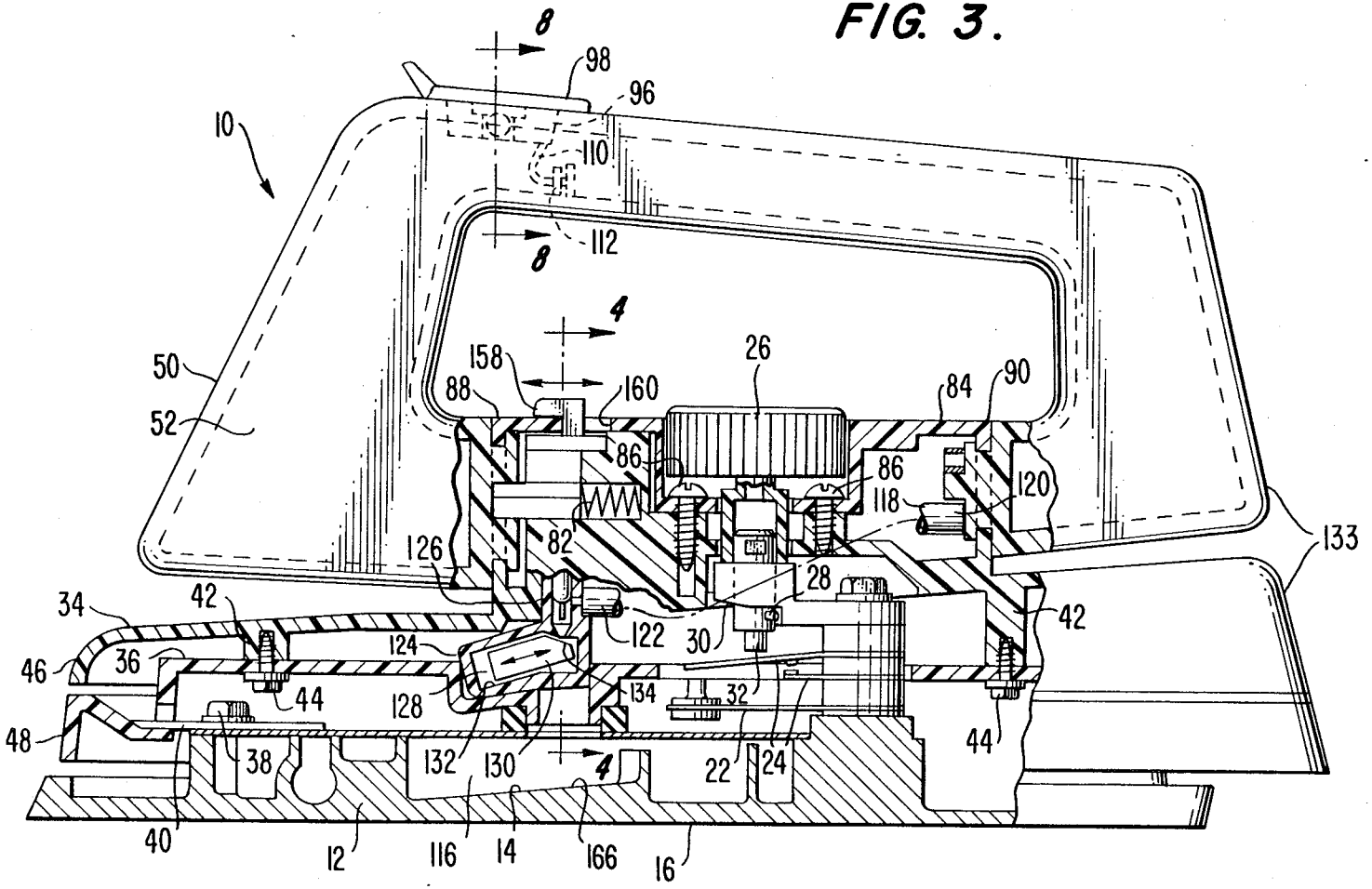
FIG. 3 is a side elevation view in partial cross section of the travel iron.
Figure 9:
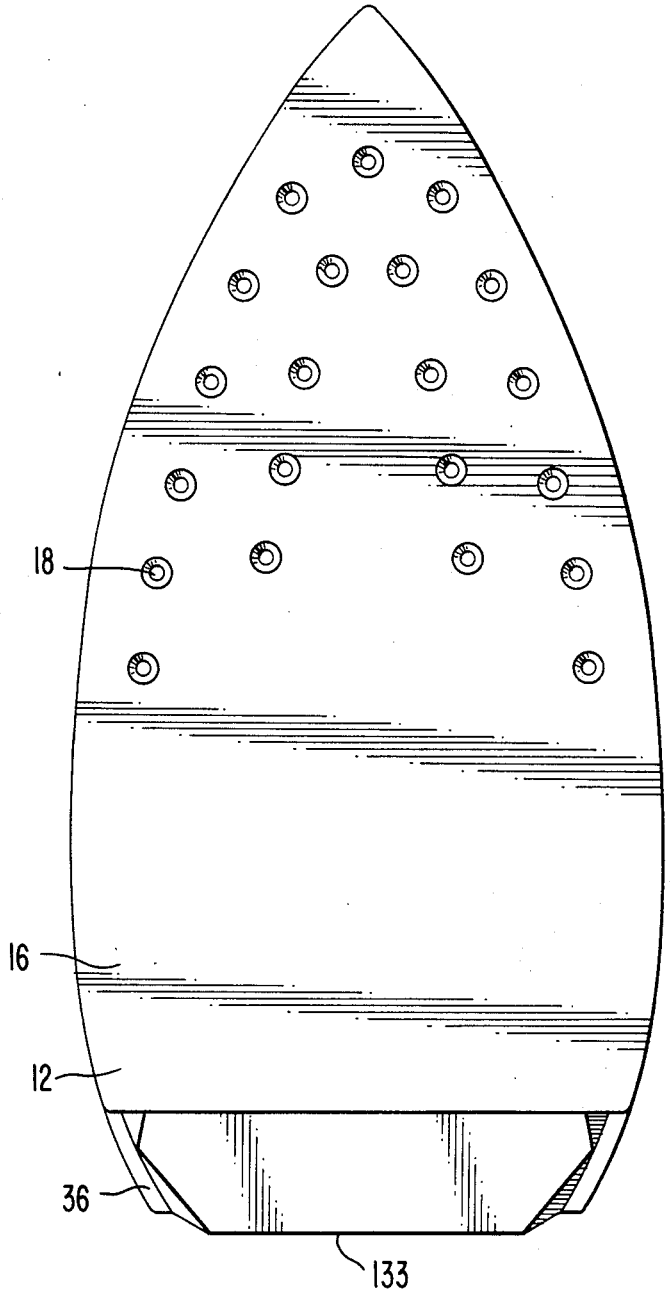
FIG. 9 is a bottom view of the travel iron.

In FIGS. 1 and 3 there is shown a travel iron 10 having a soleplate 12 with inner surface 14 and outer surface 16. An array of steam ports 18 communicating between inner surface 14 and outer surface 16 is shown in FIG. 9. A means for electrically heating the soleplate includes an electric cord for transmitting electrical current to a conventional heating element associated with soleplate 12. Also included are means for controlling the temperature of the soleplate which preferably includes a temperature sensing means such as bimetallic strip 22, a set of electric contacts 24 and a rotatable control knob 26 which is connected to a cam follower 28. Cam follower 28 rides along cam surface 30 causing rod end 32 to appropriately position contacts 24 corresponding to a temperature which is manually set by positioning control knob 26. Temperature sensing means such as bimetallic strip 22 adds an appropriate biasing force on contacts 24 depending on the temperatures which it senses. Accordingly, the means for controlling the temperature of the soleplate act in combination with bimetallic strip 22 so that contacts 24 remain closed until bimetallic strip 22 senses the temperature set on control knob 26. At that time, contacts 24 open to cut off current flow to the heating element in soleplate 12 thereby preventing soleplate 12 from exceeding the temperature set by control knob 26. When bimetallic strip 22 senses a temperature less than the temperature set by control knob 26, contacts 24 close to allow current flow to the heating element in soleplate 12 thereby allowing soleplate 12 to heat to the temperature set on control knob 26.

Travel iron 10 also includes housing means 34 and intermediate plate means 36 which are preferably made of heat-resistant plastic. Intermediate plate means 36 is direectly attached to soleplate 12 through the use of fastening means such as screw 38 and metallic flange 40. Housing means 34 preferably includes integrally molded spacer posts 42 which are internally threaded to receive screws 44 which pass through pre-formed apertures in intermediate plate means 36. In this way, housing means 34 is attached to intermediate plate means 36 which in turn is connected to soleplate 12. By attaching housing means 34 to soleplate 12 through intermediate plate means 36 housing means 34 is spaced to soleplate 12. By attaching housing means 34 to soleplate 12 from intermediate plate means 36, which in turn is spaced from soleplate 12 for limiting heat transfer from soleplate 12 to housing means 34. Housing means 34 includes a dependent peripheral edge 46 extending toward but spaced from intermediate plate means 36. Intermediate plate means includes a depending peripheral edge 48 extending towards but spaced from soleplate 12.

Travel iron 10 is provided with a hollow handle 50 which defines a liquid reservoir 52 in its interior. Hollow handle 50 is pivotally mounted to the housing for movement between an operative position indicated by the solid lines in FIG. 2 and a stored position indicated by the broken lines in FIG. 2. Handle 50 includes a first pivot part 54 and a second pivot part 56 which are integrally molded surfaces that are axially aligned. Housing 34 includes trunions 58 and 60 which accommodate portions of first pivot part 54 and second pivot part 56, respectively.

Figure 6:
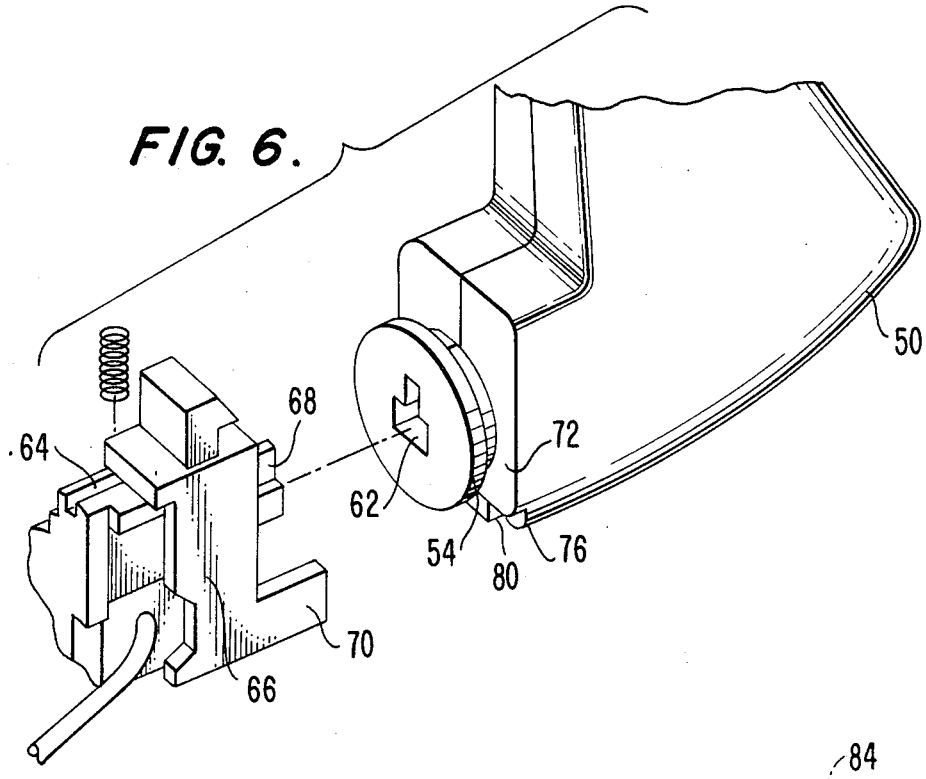
FIG. 6 is a partially exploded (bottom 1) perspective view of a portion of the travel iron which engages one end of the handle.
Figure 7:
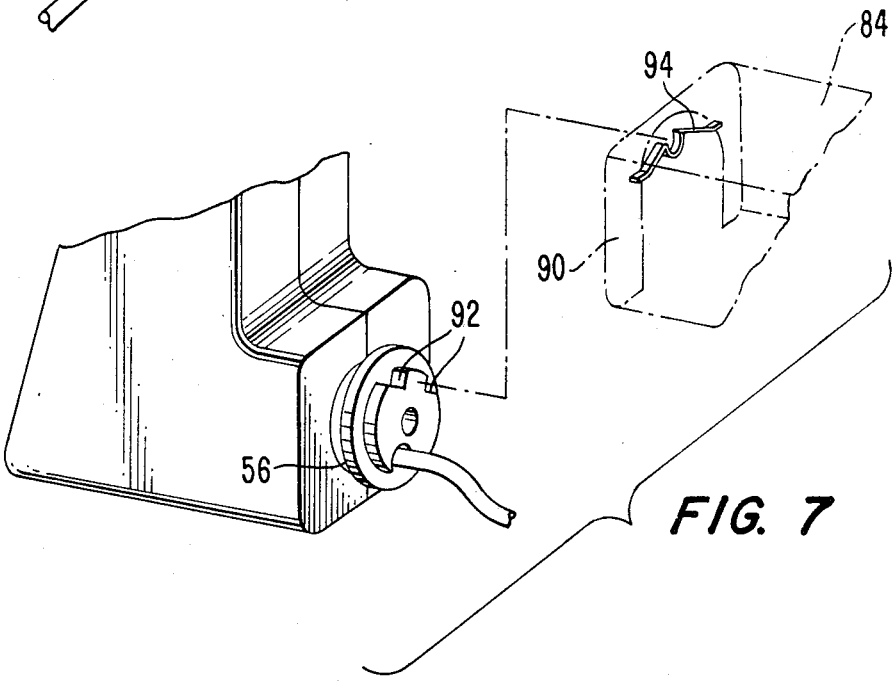
FIG. 7 is a partially exploded perspective view of a second end of the handle and its relationship to the remainder of the travel iron.

Travel iron 10 is also provided with means for releasably securing handle 50 in the operative position. This means preferably includes a keyway 62 in first pivot part 54, a corresponding keyway 64 integrally molded in housing means 34, and a sliding latch 66 slidably mounted in a corresponding keyway 64. Latch 66 has a first sliding part 68, which is complementary to keyway 62 and corresponding keyway 64, and is used for selective engagement of keyway 62 when handle 50 is in the operative position. Latch 66 also includes a second sliding part 70 for selective engagement with handle 50. Second sliding part 70 is integral with, but spaced from, first sliding part 68. First pivot part 54 preferably includes a radially extending wall 72 such that selective engagement between second sliding part 70 and handle 50 occurs at a radially outer portion of wall 72. Wall 72 preferably includes first corner portion 74 and second corner portion 76 which are proximate to housing means 34 when handle 50 is in the operative position, such that first corner portion 74 is engageable with housing means 34 and second corner portion 76 is engageable with second sliding part 70. In the preferred embodiment, housing 34 includes in integral step 78 for engagement with first corner portion 74 and second corner portion 76 includes a notch 80 for accommodating second sliding part 70. This arrangement allows second sliding part 70 to wedge handle 50 against housing 34 when sliding latch 66 is selectively engaged with handle 50. Sliding latch 66 is preferably biased into engagement with handl 50 by latch biasing means such as spring 82 so that sliding latch 66 engages handle 50 when handle 50 is pivoted into the operative position. As can be seen from FIG. 6, radially extending wall 72 is arranged to extend a sufficient radial distance to block second sliding part 70 from pivotally securing handle 50 when handle 50 is in a position other than the operative position.

A portion of housing means 34 is covered with panel means 84 and is attached to housing means 34 by screws 86. Panel means 84 form trunion 88 and 90 complementary to trunion 58 and 60 in housing means 34 for accommodating first pivot part 64 and second pivot part 56 of handle 50. The outside surface of panel means 84 is substantially aligned with the outside surface of handle 50 when handle 50 is both in the operative position and in the stored position. Second pivot part 56 includes two indentations 92 and panel means 84 includes spring means 94 mounted near trunion 90 for engagement with indentations 92 for retaining handle 50 in the stored position and in the operative position.

Figure 8:
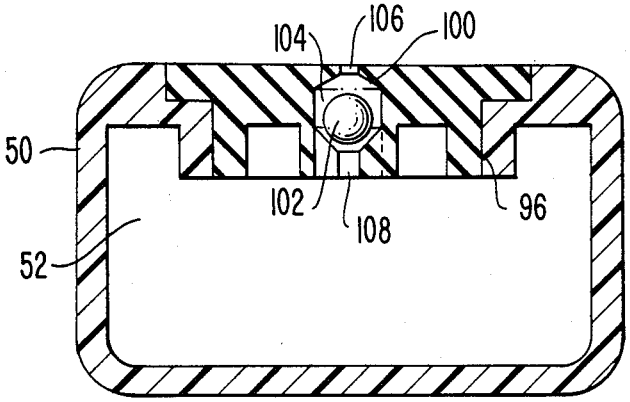
FIG. 8 is an end view in cross section taken along lines 8—8 of FIG. 3.

Handle 50 also includes means for filling handle 50 with liquid such as orifice 96 and an orifice closure 98. Orifice closure 98 is preferably constructed of a flexible plastic material and includes vent valve means for allowing ambient air to enter the reservior and for preventing liquid from leaving the reservoir. Preferably, as depicted in FIG. 8, the vent valve means includes a ball valve 100 including ball 102 which is movable in chamber 104 having an external port 106 in communication with the ambient air and an internal port 108 in communication with reservoir 52. Ball valve chamber 104 is shaped so that ball valve 100 is closed when the soleplate 12 is in a generally vertical plane preventing liquid in reservoir 52 from leaking through ports 106 and 108. Conversely, when soleplate 12 is disposed in a horizontal plane in an ironing position, ball valve 100 is open so that air may enter reservoir 52 to make up for the displaced volume lost in reservoir 52 by the outward flow of liquid from the reservoir which is used to produce steam. Orifice closure 98 is prevented from separating from handle 50 by retaining strap 110 which is fastened to a projection 112 inside handle 50.

Second pivot part 56 includes integrally formed tube 114 in fluid communication with reservoir 52. Steam generation chamber 116 is formed in the inner surface of soleplate 12. Conduit means for conducting liquid from the reservoir to steam generation chamber 116 includes a flexible tube 118 having one end 120 connected to rigid tube 114 and a second end 122 connecteed to a conduit valve means for controlling fluid flow through the conduit means. The conduit valve means preferably includes a gravity operated valve means 124 and a manually operated valve means 126.

Figure 2:
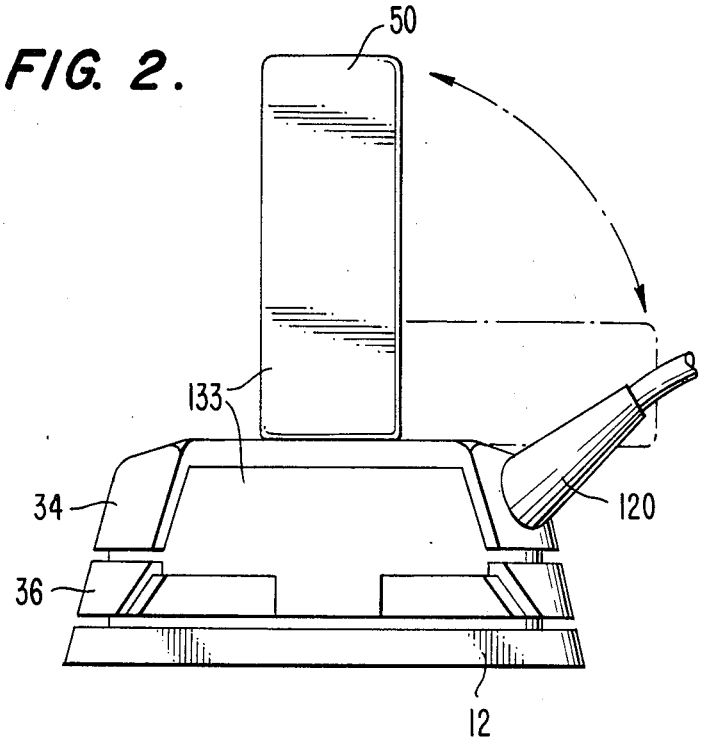
FIG. 2 is an end view of the travel iron.

Gravity operated valve means 124 includes a chamber 128 and a slug 130 which is slidable along a slide surface 132 in chamber 128 between a flow permitting position when slug 130 is in the lower portion of chamber 128 and a flow prohibiting position when slug 130 is in the upper portion of chamber 128 as shown in FIG. 3. Slide surface 132 is oriented at an acute angle relative to soleplate 12 so that when travel iron 10 is in the ironing position with soleplate 12 in a horizontal plane, slug 130 slides by gravity into the lower portion of chamber 128 to a flow permitting position. When travel iron 10 is placed in a rest position with soleplate 12 in a generally vertical plane, slug 130 moves to what is shown as the upper portion of chamber 128 in FIG. 3 to a flow prohibiting position. As shown in FIG. 3, the upper surface of slug 130 has a liquid receiving surface means 134 which is oriented at an acute angle relative to the soleplate for allowing water droplets to slide off rather than cling to slug 130 when travel iron 10 is in the ironing position. As shown in FIGS. 1 and 2, housing 34 and handle 50 cooperate to define a resting surface 133 permitting placement of the iron in a rest position with soleplate 12 in a generally vertical plane.

Figure 4:
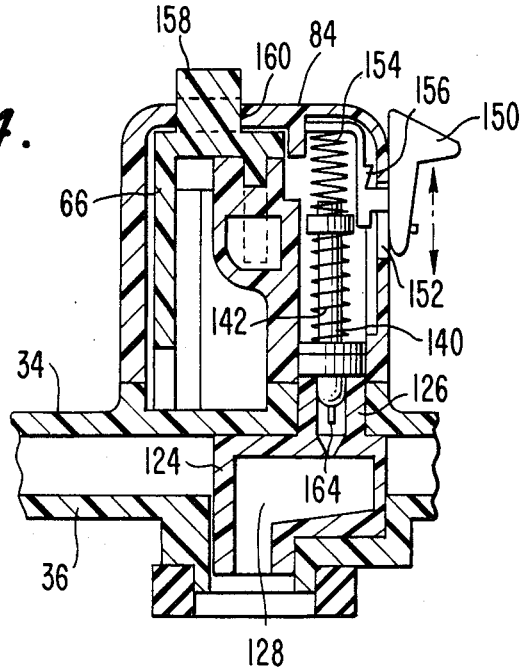
FIG. 4 is a side elevation view in cross section taken from the line 4—4 of FIG. 3.
Figure 5:
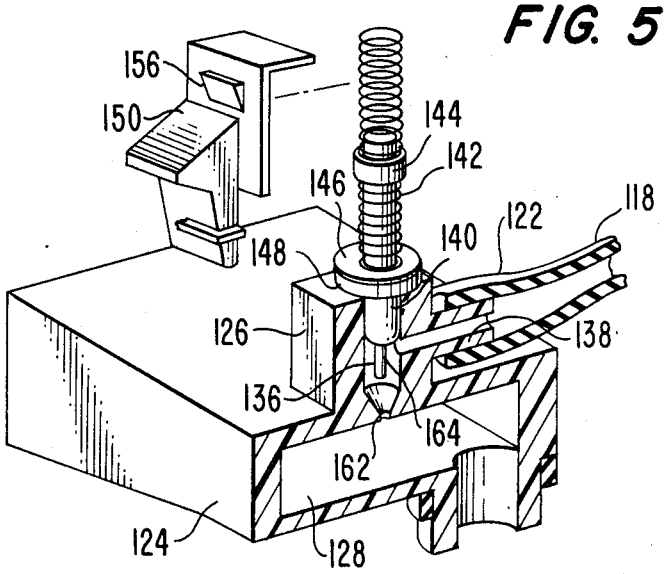
FIG. 5 is a perspective view in partial cross section of a portion of the apparatus shown in FIG. 4.

As shown in FIGS. 4 and 5, manually operated valve means 126 includes a chamber 136 which is in fluid communication with the interior of rigid tube 138. Rigid tube 138 is attached to end 122 of flexible tube 118. Manually operated valve means 126 also includes a plunger member 140 which can be manually slid downward to prohibit flow through manually operated valve means 126. Plunger 140 is biased in an upward position by spring 142 engaging a rim 144 on plunger member 140. The other end of spring 142 engages washer 146 which freely slides on plunger member 140 along with sealing ring 148. Plunger 140 is actuated by slide 150 which is mounted in panel means 84 for sliding movement within in orifice 152 in panel means 84. Spring 154 is used to connect the top end of plunger 140 to actuating slide 150 thereby maintaining actuating slide 150 in an upper position as shown in FIG. 4 until it is manually depressed into a lower position where it can be temporarily locked through the use of protruding latch 156 which engages the top portion of orifice 152. As shown in FIG. 1, panel means 84 also includes a second orifice 160 for accommodating a third sliding part 158 of sliding latch 66.

As can be seen in FIGS. 4 and 5, the outlet of manually operated valve means 126 is also the inlet of gravity operated valve means 124. Also, the outlet of manually operated valve means 126 converges to form a metering orifice 162 to deliver drops of liquid to gravity operated valve means 124. Plunger 140 includes pin means 164 for clearing metering orifice means 162 when plunger member 140 is actuated.

As seen in FIG. 3, the outlet of gravity operated valve means 124 is open to soleplate 12 so as to deliver drops of liquid to a slanted steam boiler surface 166 on the inside surface 14 of soleplate 12. The liquid flows onto slanted steam boiler surface 166 in the form of drops. As the drops roll down the slanted steam boiler surface 166, they quickly absorb heat and rapidly vaporize into steam. As shown in FIG. 3, temperature sensing means such as bimetallic strip 22 is located near slanted steam boiler surface 166 to better control the amount of heat provided to soleplate 12.

Rotatable control knob 26 includes finger means 168 for contacting a surface 170 having a plurality of indentations around its periphery for positive registration with finger means 168. Control knob 26 also includes flanges 172 which contact surface 174 of panel means 84 to fasten the control knob to panel means 84 without requiring the use of screws.

A final feature of travel iron 10 is that the composition of handle 50 is such that the water level of reservoir 52 can be easily seen. Therefore, handle 52 is preferably made substantially from a transparent or translucent material.

The operation of travel iron 10 will now be described. Travel iron 10 is stored in a compact position such that handle 50 is placed in the compact position shown by broken lines in FIG. 2. When put into use, handle 50 is placed in the operative postion shown by solid lines in FIG. 2. This is accomplished by pivoting it into this position where first sliding part 68 slides into keyway 62 and second sliding part 70 slides into notch 80 through the biasing action of spring 82. Orifice closure 98 is lifted from orifice 96 in handle 50, and reservoir 52 inside hollow handle 50 is filled with water. Orifice closure 98 is reinserted in orifice 96, and electric cord 20 is plugged into an electric outlet. Control knob 26 is rotated to a position corresponding to the temperature proper for the textile which is to be ironed. The iron is left to heat in a rest position with soleplate 12 in a generally vertical plane.

Rotation of control knob 26 causes electric contacts 24 to close and current to be supplied to the heating element in soleplate 12. When soleplate 12 reaches the predetermined temperature corresponding to the setting of control knob 26, temperature sensing means such as bimetallic strip 22 moves into a position such that electric contracts 24 are pushed apart thereby cutting off the supply of the current to the heating element and preventing the iron from overheating. As the iron begins to cool, bimetallic strip 22 begins to move in the other direction and eventually causes the electric contacts 24 to close thereby causing the heating element to once again restore soleplate 12 to the temperature set on control knob 26. It is by this arrangement that the temperature of soleplate 12 is maintained at the temperature set on control knob 26.

When travel iron 10 has reached the predetermined temperature, the operator has the option of deciding whether to use the iron in a steam mode or a dry mode. If the operator desires a dry mode, he pushes down actuating slide 150 until latch 156 lodges in the top wall of orifice 152. This causes plunger member 140 to block flow of liquid through manually operated valve means 126. If a steam setting is desired, actuating slide 150 is left in an up position and plunger member 140 allows flow through manually operated valve means 126.

The iron is then placed in an ironing postion such that soleplate 12 is in a horizontal plane. This causes slug 130 in gravity operated valve means 124 to slide downward on surface 132 to permit liquid flow through gravity operated valve means 124. Liquid flows from reservoir 52 through tube 114, then through flexible tube 118 to tube 138 in manually operated valve means 126. Liquid then flows through metering orifice 162 and enters gravity operated valve means 124 in the form of droplets. Liquid droplets land on liquid receiving surface means 134 of slug 130 and slide down liquid receiving surface means 134 and out gravity operated valve means 124 onto slanted steam boiler surface 166. The liquid droplets quickly vaporize into steam while sliding down slanted steam boiler surface 16 and the steam is conveyed through steam ports 18 to outer surface 16 of soleplate 12.

Ambient air enters ball valve 100 through external port 160 and enters reservoir 52 to replace the volume of the water which is being transmitted through the conduit means to soleplate 12 to generate steam. Clothes or other textiles may now be ironed and the iron is kept in a steam generating mode so long as actuating slide 150 is properly positioned. The iron is maintained in a position such that soleplate 12 is in a horizontal plane in the ironing position.

When ironing is interrupted such as to change the workpiece, the iron is placed in a rest position such that soleplate 12 is in a generally vertical plane. Gravity operated valve means 124 then closes because slug 130 slides to block the flow of fluid due to gravity positioning. At the same time, ball valve 100 closes to prevent liquid from flowing out of reservoir 52 through external port 106. When ironing is resumed, the iron is placed in an ironing position such that gravity operated valve means 124 and ball valve 100 again open to permit liquid to flow through gravity operated valve means 124 to slanted steam boiler surface 166 and allow ambient air to replace the volume of water lost from reservoir 52 due to this flow.

When ironing has been completed, control knob 2 may be rotated to an off position thereby opening contacts 24 and cutting off current to the heating element in soleplate 12. Electric cord 20 can be unplugged and handle 50 may be pivoted from the operative position to the stored position by sliding back third sliding part 158 of latch 66 and rotating the handle until it reaches the position marked in dotted lines in FIG. 2.

Additional advantages and modifications will readily occur to those skilled in the art. The invention in its broader aspects is, therefore, not limited to the specific details, representative apparatus and illustrative examples shown and described. Accordingly, departure may be made from such details without departing from the spirit or scope of applicant's general inventive concept.

What is claimed is:

1. A travel steam and dry iron comprising:

(a) a soleplate having inner and outer surfaces and an array of steam ports communicating between the inner and outer surfaces;

(b) means for electrically heating the soleplate;

(c) means for controlling the temperature of the soleplate;

(d) housing means fixed to said soleplate, a substantial portion of the housing means being spaced from the soleplate for limiting heat transfer from the soleplate to the housing means;

(e) a hollow handle defining a liquid reservoir and pivotally mounted to the housing for movement between operative and stored positions;

(f) means for releasably securing the handle in said operative position;

(g) means including an orifice in the handle for filling said handle with liquid and an orifice closure;

(h) conduit means for conducting liquid from the reservoir to the soleplate; and (i) vent valve means in communication with the reservoir for allowing air to enter the reservoir and preventing liquid from leaving the reservoir, wherein the vent valve means is located in the orifice closure.

2. A travel steam and dry iron comprising:

(a) a soleplate having inner and outer surfaces and an array of steam ports communicating between the inner and outer surfaces;

(b) means for electrically heating the soleplate;

(c) means for controlling the temperature of the soleplate;

(d) housing means fixed to said soleplate, a substantial portion of the housing means being spaced from the soleplate for limiting heat transfer from the soleplate to the housing means;

(e) a hollow handle defining a liquid reservoir and pivotally mounted to the housing for movement between operative and stored positions, wherein the handle includes first and second pivot parts that are axially aligned and spaced for said pivotal mounting to the housing;

(f) means for releasably securing the handle in said operative position, wherein the means for releasably securing the handle includes a keyway in the first pivot part and a sliding latch mounted on the housing proximate to the first pivot part and having a first sliding part for selective engagement with the keyway, said sliding latch including means for manually engaging and operating said latch, so that the handle is locked in the operative position when the handle is in the operative position and the latch is engaged with the keyway, and said handle is releasable from the operative position when said manual engagement means is manually operated to withdraw said latch from said keyway;

(g) means for filling said handle with liquid; and (h) conduit means for conducting liquid from the reservoir to the soleplate.

3. The iron of claim 2 wherein the latch includes a second sliding part for selective engagement with the handle, the second sliding part spaced from the first sliding part.

4. The iron of claim 3 wherein the first pivot part includes a radially extending wall and wherein selective engagement between the second sliding part and the handle occurs at a radially outer portion of the wall.

5. The iron of claim 4 including latch biasing means for biasing the sliding latch into engagement with the handle.

6. The iron of claim 5 wherein the radially extending wall is arranged to block the second sliding part from pivotally securing when the handle is in a position other than the operative position.

7. The iron of claim 4 wherein the wall includes first and second corner portions which are proximate to the housing means when the handle is in the operative position, such that the first corner portion is engageable with the housing means and the second corner portion is enageable with the second sliding part.

8. The iron of claim 3 wherein the second sliding part wedges the handle against the housing when in selective engagement with the handle.

9. The iron of claim 2 wherein the housing includes a keyway for engagement with the first sliding part.

10. The iron of claim 2 including panel means attached to the housing means for forming a trunion for the pivotally mounted handle, a first orifice in the panel means so that the sliding latch is manually operable through the first orifice.

11. A travel steam and dry iron comprising:

(a) a soleplate having inner and outer surfaces and an array of steam ports communicating between the inner and outer surfaces;

(b) means for electrically heating the soleplate;

(c) means for controlling the temperature of the soleplate;

(d) housing means fixed to said soleplate, a substantial portion of the housing means being spaced from the soleplate for limiting heat transfer from the soleplate to the housing means;

(e) a hollow handle defining a liquid reservoir and pivotally mounted to the housing for movement between operative and stored positions;

(f) means for releasably securing the handle in said operative position wherein said housing and said handle cooperate to define a resting surface permitting placement of the iron in a rest position in which the soleplate is disposed in a generally vertical plane;

(g) means for filling said handle with liquid; and (h) conduit means for conducting liquid from the reservoir to the soleplate; and (i) vent valve means in communication with the reservoir for allowing air to enter the reservoir and preventing liquid from leaving the reservoir.

12. The iron of claim 11 wherein the vent valve means is open when the soleplate is disposed in a generally horizontal plane so that the iron is in an ironing position and closed when the iron is in said rest position.

13. A travel steam and dry iron comprising:

(a) a soleplate having inner and outer surfaces and an array of steam ports communicating between the inner and outer surfaces;

(b) means for electrically heating the soleplate;

(c) means for controlling the temperature of the soleplate;

(d) housing means fixed to said soleplate, a substantial portion of the housing means being spaced from the soleplate for limiting heat transfer from the soleplate to the housing means;

(e) a hollow handle defining a liquid reservoir and pivotally mounted to the housing for movement between operative and stored positions;

(f) means for releasably securing the handle in said operative positions;

(g) means for filling said handle with liquid;

(h) conduit means for conducting liquid from the reservoir to the soleplate; and (i) panel means attached to the housing means and trunion means in the housing means and the panel means for engaging the pivotally mounted handle between the housing means and the panel means.

14. The iron of claim 13 wherein the outside surface of the panel means is substantially aligned with the outside surface of the handle adjacent the trunion means when the handle is in the operative position.

15. The iron of claim 14 wherein the outside surface of the panel means is substantially aligned with the outside surface of the handle adjacent the trunion means when the handle is in the stored position.

16. A travel steam and dry iron comprising:

(a) a soleplate having inner and outer surfaces and an array of steam ports communicating between the inner and outer surfaces;

(b) means for electrically heating the soleplate;

(c) means for controlling the temperature of the soleplate;

(d) housing means fixed to said soleplate, a substantial portion of the housing means being spaced from the soleplate for limiting heat transfer from the soleplate to the housing means;

(e) a hollow handle defining a liquid reservoir mounted to said housing means;

(f) means for filling said handle with liquid;

(g) conduit means for conducting liquid from the reservoir to the soleplate; and (h) conduit valve means for controlling fluid flow through the conduit means, wherein the iron is positionable in an ironing position in which the soleplate is disposed in a horizontal plane and in a rest position in which the soleplate is disposed in a generally vertical plane, said conduit valve means having gravity operated valve means for permitting gravity induced flow through the conduit means from the reservoir to the soleplate when the iron is disposed in the ironing position and prohibiting flow through the conduit means from the reservoir to the soleplate when the iron is disposed in the rest position.

17. The iron of claim 16 wherein the gravity operated valve includes a chamber and a slug slideable along a slide surface within the chamber between flow permitting and flow prohibiting positions.

18. The iron of claim 17 wherein said slide surface along which said slug is slideable is oriented at an acute angle relative to the soleplate.

19. The iron of claim 17 wherein the slug includes a liquid receiving surface means oriented at an acute angle relative to the soleplate for allowing water droplets to slide off the slug when the iron is in the ironing position.

20. The iron of claim 19 wherein the liquid receiving surface means is an upper surface of the slug when the iron is in the ironing position.

21. The iron of claim 16 wherein the conduit valve means includes a manually operated valve means for selectively controlling fluid flow through the conduit means.

22. The iron of claim 21 wherein the manually operated valve means is located above the gravity operated valve means when the iron is in the ironing position.

23. The iron of claim 22 wherein the gravity operated valve means has an inlet and an outlet and the manually operated valve means has an inlet and an outlet, the inlet of the gravity operated valve means being connected to the outlet of the manually operated valve means.

24. The iron of claim 22 wherein the conduit means between the inlet of the manually operated valve and the reservoir is a flexible hose means.

25. The iron of claim 23 wherein the inlet of the gravity operated valve means is the outlet of the manually operated valve means.

26. The iron of claim 23 wherein the outlet of the manually operated valve means diverges to form a metering orifice means to deliver drops of liquid to the gravity operated valve means.

27. The iron of claim 26 wherein the manually operated valve means includes pin means for clearing the metering orifice means.

28. The iron of claim 21 including panel means attached to the housing means for forming a control panel.

29. The iron of claim 28 including an orifice in the panel means so that the manually operated valve means is manually operable through the second orifice.

30. The iron of claim 28 wherein the handle is pivotable relative to the housing means and wherein the panel means forms a trunion for the handle.

31. The iron of claim 16 wherein the handle is pivotable relative to the housing means.

32. A travel steam and dry iron comprising:

(a) a soleplate having inner and outer surfaces and an array of steam ports communicating between the inner and outer surfaces;
(b) means for electrically heating the soleplate;
(c) means for controlling the temperature of the soleplate;
(d) housing means fixed to said soleplate, a substantial portion of the housing means being spaced from the soleplate for limiting heat transfer from the soleplate to the housing means;
(e) intermediate plate means between the housing means and the soleplate, wherein the intermediate plate means is substantially spaced from both the housing means and the soleplate to limit heat transfer from the soleplate to the housing means;
(f) a hollow handle defining a liquid reservoir mounted to said housing means;
(g) means for filling said handle with liquid;
(h) conduit means for conducting liquid from the reservoir to the soleplate; and
(i) conduit valve means for controlling fluid flow through the conduit means.

33. The iron of claim 32 wherein both the housing means and the intermediate plate means extend along at least a substantial portion of the area of the soleplate.

34. The iron of claim 32 wherein the housing means includes a depending peripheral edge extending toward, but spaced from, the intermediate plate means.

35. The iron of claim 32 wherein the intermediate plate means includes a depending peripheral edge extending toward, but spaced from, the soleplate.

36. The iron of claim 32 wherein at least a substantial portion of the conduit valve means is located between the intermediate plate means and the housing means.

37. A travel steam and dry iron comprising:

(a) a soleplate having inner and outer surfaces and an array of steam ports communicating between the inner and outer surfaces;
(b) means for electrically heating the soleplate;
(c) means for controlling the temperature of the soleplate including a temperature sensing means located near the central region of the soleplate;
(d) housing means fixed to said soleplate, a substantial portion of the housing means being spaced from the soleplate for limiting heat transfer from the soleplate to the housing means;
(e) a hollow handle defining a liquid reservoir mounted to said housing means;
(f) means for filling said handle with liquid;
(g) conduit means for conducting liquid from the reservoir to the soleplate;
(h) conduit valve means for controlling fluid flow through the conduit means; and
(i) intermediate plate means between the housing means and the soleplate wherein the intermediate plate is substantially spaced from both the housing means and the soleplate to limit heat transfer from the soleplate to the housing means.

38. The iron of claim 37 including a slanted steam boiler surface formed on the inner surface of the soleplate and communicating with the steam ports.

39. The iron of claim 38 wherein the means for controlling the temperature of the soleplate includes a temperature sensing means located near the steam boiler surface.

40. A travel steam and dry iron comprising:

(a) a soleplate having inner and outer surfaces and an array of steam ports communicating between the inner and outer surfaces;
(b) means for electrically heating the soleplate;
(c) means for controlling the temperature of the soleplate;
(d) housing means fixed to said soleplate, a substantial portion of the housing means being spaced from the soleplate for limiting heat transfer from the soleplate to the housing means;
(e) a hollow handle defining a liquid reservoir mounted to said housing means;
(f) means for filling said handle with liquid;
(g) conduit means for conducting liquid from the reservoir to the soleplate;
(h) conduit valve means for controlling fluid flow through the conduit means; and
(i) panel means attached to the housing means for forming a control panel, said panel means having a radial surface with a plurality of indentations wherein the means for controlling the temperature of the soleplate includes a rotatable control knob proximate to the panel means, axially extending finger means on the control knob for positive registration with said indentation in the radial surface of the panel means and resisting rotation of the knob.

41. The iron of claim 40 wherein the control knob includes flange means for fastening the control knob to the panel means.

42. A travel iron comprising:

(a) a soleplate;

(b) means for electrically heating the soleplate;

(c) means for controlling the temperature of the soleplate;

(d) housing means fixed to the soleplate, a substantial portion of the housing means being spaced from the soleplate for limiting heat transfer from the soleplate to the housing means;

(e) an intermediate plate means between the housing means and the soleplate wherein the intermediate plate means is substantially spaced from both the housing means and the sole plate to limit heat transfer from the soleplate to the housing means;

(f) a handle pivotally mounted to the housing for movement between operative and stored positions.

(g) means for releasably securing the handle in said operative position; and (h) panel means attached to the housing for forming a control panel.

43. The iron of claim 42 wherein the housing means includes a depending peripheral edge extending toward but spaced from the intermediate plate means.

44. The iron of claim 42 wherein the intermediate plate means includes a depending peripheral edge extending toward, but spaced from, the soleplate.

45. The iron of claim 42 wherein the means for controlling the temperature of the soleplate includes a temperature sensing means located near the central region of the soleplate.

46. The iron of claim 42 wherein the means for controlling the temperature of the soleplate includes a rotatable control knob proximate to the panel means, finger means on the control knob for contacting the panel means and resisting rotation of the knob.

47. The iron of claim 46 wherein the panel means includes a surface having a plurality of indentations for positive registration with the finger means.

48. The iron of claim 46 wherein the control knob includes flange means for fastening the control knob to the panel means.

49. A travel iron comprising:

(a) a soleplate;

(b) means for electrically heating the soleplate;

(c) means for controlling the temperature of the soleplate;

(d) housing means fixed to said soleplate, a substantial portion of the housing means being spaced from the soleplate for limiting heat transfer from the soleplate to the housing means; and (e) a handle pivotally mounted to the housing for movement between operative and stored positions and means for releasably securing the handle in said operative position, wherein the handle includes first and second pivot parts that are axially aligned and spaced for said pivotal mounting to the housing, wherein the means for releasably securing the handle includes a keyway in the first pivot part and a sliding latch mounted on the housing proximate to the first pivot part and having a first sliding part for selective engagement with the keyway, said sliding latch including means for manually engaging and operating said latch, so that the handle is locked in the operative position when the handle is in the operative position and the latch is engaged with the keyway, and said handle is releasable from the operative position when said manual engagement means is manually operated to withdraw said latch from said keyway.

50. The iron of claim 49 wherein the latch includes a second sliding part for selective engagement with the handle, the second sliding part spaced from the first sliding part.

51. The iron of claim 50 wherein the first pivot part includes a radially extending wall and wherein selective engagement between the second sliding part and the handle occurs at a radially outer portion of the wall.

52. The iron of claim 51 wherein the wall includes first and second corner portions which are proximate to the housing means when the handle is in the operative position, such that the first corner portion is engageable with the housing means and the second corner portion is engageable with the second sliding part.

53. The iron of claim 52 wherein the second sliding part wedges the handle against the housing when in selective engagement with the handle.

54. The iron of claim 53 wherein the housing includes a keyway for engagement with the first sliding part.

55. The iron of claim 50 wherein the radially extending wall is arranged to block the second sliding part from pivotally securing when the handle is in a position other than the operative position.

56. A travel steam and dry iron comprising:

(a) a soleplate having inner and outer surfaces and an array of steam ports communicating between the inner and outer surfaces;

(b) means for electrically heating the soleplate;

(c) means for controlling the temperature of the soleplate;

(d) housing means fixed to said soleplate, a substantial portion of the housing means being spaced from the soleplate for limiting heat transfer from the soleplate to the housing means;

(e) a hollow handle defining a liquid reservoir and pivotally mounted to the housing for movement between operative and stored positions;

(f) means for releasably securing the handle in said operative position;

(g) means for filling said handle with liquid;

(h) conduit means for conducting liquid from the reservoir to the soleplate;

(i) gravity operated valve means for permitting flow through the conduit means when the soleplate of the iron is disposed horizontally in an ironing position and for prohibiting flow through the conduit means when the soleplate of the iron is disposed vertically in a rest position; and (j) manually operated valve means for selectively controlling fluid flow through the conduit means.

* * * * *